United States Patent [19]

Zion et al.

[11] Patent Number: 4,979,666

[45] Date of Patent: Dec. 25, 1990

[54] ARTICULATED TRAY APPARATUS

[75] Inventors: Kenneth J. Zion, New Lenox; Ronald G. Kantola, Waukegan, both of Ill.

[73] Assignee: Stone Container Corporation, Chicago, Ill.

[21] Appl. No.: 345,569

[22] Filed: May 1, 1989

[51] Int. Cl.[5] ..... B65D 5/22; B65D 43/16

[52] U.S. Cl. ..... 229/101; 229/138; 229/164

[58] Field of Search ..... 229/40, 101, 103, 138, 229/139, 164, DIG. 2, DIG. 4; 206/427

[56] References Cited

U.S. PATENT DOCUMENTS

| | | | |
|---|---|---|---|
| 2,810,506 | 10/1957 | Kessler | 229/138 |
| 3,112,853 | 12/1963 | Welshenbach | 229/139 |
| 3,346,399 | 10/1967 | Watson et al. | 229/101 |
| 3,502,488 | 3/1970 | Bridgford | 229/138 |
| 3,581,977 | 6/1971 | Kirsky | 229/138 |
| 4,782,788 | 11/1988 | Arcand | 229/139 |

FOREIGN PATENT DOCUMENTS

| | | | |
|---|---|---|---|
| 616205 | 3/1961 | Canada | 229/138 |

*Primary Examiner*—Gary E. Elkins

*Attorney, Agent, or Firm*—Dick and Harris

[57] ABSTRACT

An articulated tray apparatus for describing a shallow depth container for use on conveyor packaging lines, capable of retaining loose piece-part objects deposited therein, and constructed in a manner to permit formation of the container by automated trayformer-carton erection equipment as well as to permit facilitated closure of the apparatus after filling. At least two opposite side walls and respective top panels are joined, upon articulation of the container blank, to at least two opposite end walls and respective end panels, by connection flaps which have upper and lower portions connected to one another. The upper portion of the connection flaps each contain an articulation fold line for facilitating articulation and closure of the connection flaps, while relieving resistance upon closure and sealing of the container.

14 Claims, 3 Drawing Sheets

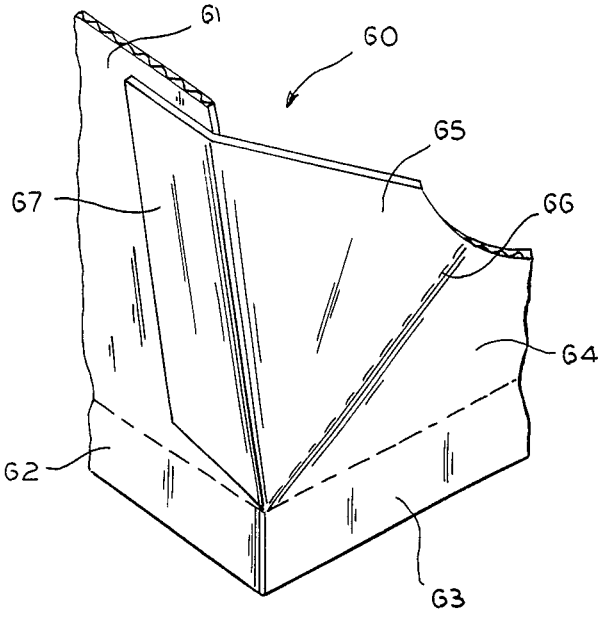
FIG. 8
(PRIOR ART)
FIG. 9
(PRIOR ART)
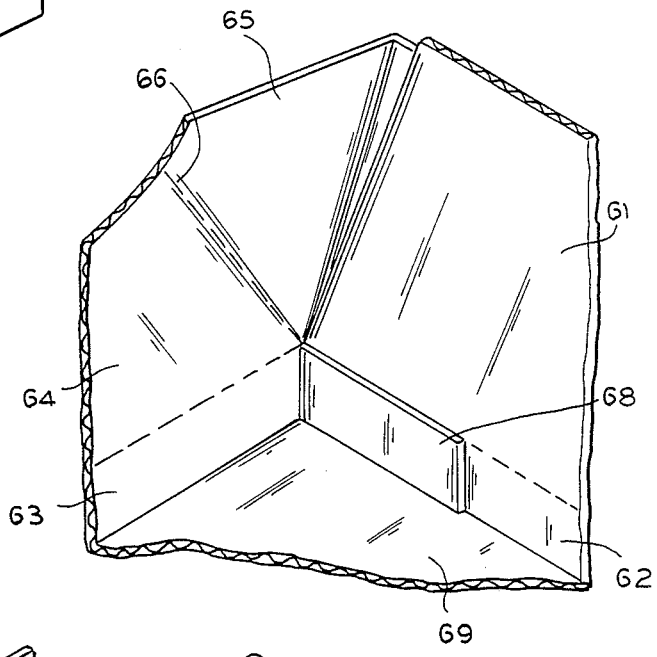
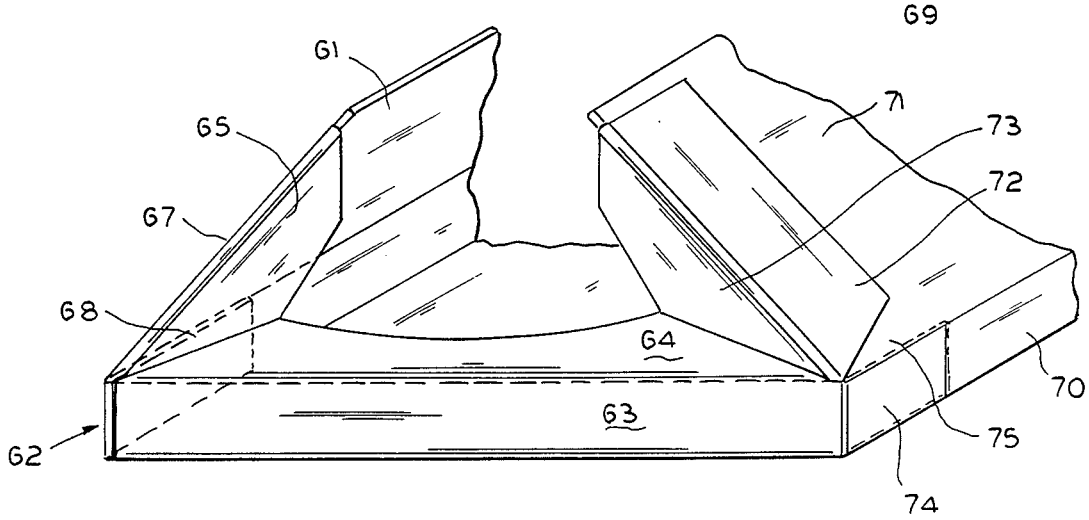
FIG. 10
(PRIOR ART)

ARTICULATED TRAY APPARATUS

BACKGROUND OF THE INVENTION

The present invention relates generally to container products and specifically an articulated tray apparatus for articulation into a shallow depth container for use on large conveyor packaging lines, capable of retaining loose objects deposited therein as the container moves down a conveyor line. The present invention is constructed in a manner so as to permit the formation of the container by mechanical tray former - carton erection equipment as well as to prompt articulated closure and sealing of the container.

In an effort to reduce cost it has long been an object of businesses to improve the efficiency of the business as it relates to the manufacture of goods. An ever increasing area of attention has proved to be the costs associated with packaging the business, goods prior to their shipment to the consumer. Towards this end, it has become common to find large scale packaging lines utilized by business wherein a previously assembled open container, often made of corrugated cardboard, is transported down a conveyor belt past employees of the business who fill customer orders for goods by selecting ordered piece-parts and by placing them in the container as it moves down the conveyor past the employee's work station.

In an effort to improve the efficiency of this process, attempts have been directed towards automating the packaging procedure where possible, giving particular attention to the human labor factor. In many cases however it is inappropriate, or otherwise uneconomical, to replace the employee with automated equipment, particularly where a large variation and size range of goods is required to be packaged. It therefore becomes desirable to configure a large scale packaging line wherein corrugated cardboard containers, for example, would be automatically erected by appropriate machinery at the beginning of a conveyor line, with the open container transported down the moving conveyor past individuals positioned at their work stations where such individuals would select and deposit the goods into the container as the container passes the individual work stations. Efforts have likewise been directed towards automating the facilitated closure and sealing of such a filled box, at the end of the conveyor line, where the last individual folds the four flaps of a conventional carton over, to close the carton and guide it into a taping machine which would join the two major flaps together where they meet along the center line of the container.

With the high costs associated with transportation and storage, and the ever-increasing costs of container stock, it is desirable to utilize a packaging container which conforms as closely as possible to the shape of the goods sought to be shipped to the consumer, in order to minimize the amount of cardboard required and the shipping volume of the overall object to be shipped or stored.

In many cases where the goods sought to be shipped are extremely thin, such as, for example, automotive gasket material or books and publications, shallow depth containers are utilized in order to minimize the size of the container.

Unfortunately, typical prior art shallow depth containers are either constructed with breaks in the peripheral walls, through which small parts being packaged can migrate, or are often constructed in a manner which utilizes corner tab members to form, join and seal adjacent sides of a container together to form containment corners. Such tab members typically possess at least one dimension which is approximately equal to the depth of the container as established by the dimension of the side wall of the container. In shallow depth containers, the side walls and thus the corner tab member may be quite small, often on the order of one-half to three-quarters of an inch.

In order to assemble the container from a pre-cut carton blank, these narrow tab members must be separated from the other panels forming the carton blank, manipulated into position, aligned, glued and/or otherwise adhered to the appropriate adjacent side wall of the container in order to form a rigid corner. The use of such narrow corner tab members thus typically renders shallow container blanks unsuitable for assembly by automated tray former - carton erection equipment due to the inability of such equipment to reliably manipulate the small corner tabs into place and precisely deposit adhesive glue on the small corner tab members.

Accordingly, it is an object of the present invention to provide a shallow depth tray apparatus for facilitated articulation, closure and sealing into a filled shallow depth container, for use on large conveyor packaging lines, while being capable of more effectively retaining goods deposited therein as the container moves down a conveyor line, prior to closure.

It is additionally an object of the present invention to provide a container blank which omits reliance upon substantially narrow corner tab members common to most shallow depth containers.

It is a further object of the invention to provide a container blank which may be formed into a shallow container by automated tray former - carton erection equipment.

It is yet another object of the invention to provide a container which may be initially formed by automated equipment, and then closed and sealed either manually or by machine, with a minimum of effort.

It is yet a further object of the present invention to provide such a container blank which utilizes connection flaps to join side walls to adjacent end walls where such connection flaps each have an upper portion and a lower portion connected thereto, and where such upper portions have articulation fold lines formed therein for facilitating articulation of the connection flap and closure of the container, with a minimum of folding resistance.

As a further object, the present invention provides for a tray apparatus constructed by articulation of a blank formed from a substantially continuous sheet of corrugated cardboard material providing for ease of assembly, resulting in cost savings and increased efficiency upon large conveyor packaging lines.

These and other objects of the invention will become apparent in light of the present specification and drawings.

SUMMARY OF THE INVENTION

The present invention comprises a substantially shallow articulated tray apparatus having a continuous wall periphery for use in effectively retaining and containing piece-parts, without substantially narrow corner tab members which are typically found in many designs of shallow depth containers. The omission of such narrow corner tab members enables the formation of the apparatus by automated mechanical tray forming carton erection equipment and further enables the automated closure and sealing of the apparatus in a facilitated manner, either manually or by automatic taper equipment.

The articulated tray apparatus itself comprises a bottom panel means, and at least two upstanding opposite side wall means which are operably attached, for articulation, to the bottom tray means along substantially continuous respective side wall fold edges therebetween. At least two opposite top panel means are operably attached, for articulation, to the respective upstanding opposite side wall means, along substantially continuous respective top panel fold edges therebetween. At least two upstanding opposite end wall means are operably attached, for articulation, to the bottom tray means, along substantially continuous respective end wall fold edges therebetween. And at least two opposite end panel means are operably attached, for articulation, to the respective upstanding opposite end wall means along substantially continuous respective end panel fold edges. The bottom panel means, side wall means, end wall means and top panel means establish the bottom, sides and top respectively of the apparatus, specifically where the height dimension of the side wall means and end wall means determine the overall depth of the apparatus.

Associated with each of the top panel means is a connection flap means attached at opposite ends of the top panel means, for juxtaposing the side wall means to the adjacent end wall means, and, the top panel means to the adjacent end panel means upon articulation of the apparatus. When articulated, preferably by automated mechanical tray former equipment, such as is manufactured by MARQ Packaging Systems, Inc., an apparatus having a bottom panel, two side walls, two end walls and associated top panels and end panels is formed.

The connection flap means each further incorporate an upper portion and a lower portion where the upper portion is connected to the lower portion at a connection flap articulation fold line which is articulatable upon closure of the apparatus. Upon closure the juxtapositioning and affixation of the connection flap means to the end panel means provides an open sealable articulated tray apparatus capable of receiving and retaining objects within a substantially continuous closed wall periphery, while enabling automated erection, closure and sealing of the apparatus.

In the preferred embodiment of the invention the end panel means are juxtaposed and affixed to the upper portion of the connection flap means. In this embodiment, the end wall means may be further juxtaposed and affixed to the lower portion connection flap means to further reinforce the region of juxtaposition between the end wall means and the side wall means.

The articulated tray apparatus further contemplates in the preferred embodiment, the upper portion of the connection flap means including at least one articulation fold line which extends from the end of the top panel fold line diagonally across the upper portion of the connection flap means towards facilitating the articulation of the connection flap means, upon the automated closure and sealing of the apparatus. The upper portion of the connection flap means may alternatively further include a second articulation fold line extending substantially parallel to the first articulation fold line towards further facilitating the articulation of the connection flap means upon the automated closure and sealing of the apparatus. In the preferred embodiment of the invention, the first and second articulation fold lines include a plurality of perforations which are formed therewithin.

In this embodiment, the upper portion of the connection flap means is attached to, and extends substantially the entire height of each respective top panel means to further assist in retaining objects deposited within the apparatus prior to the facilitated closing and sealing of the apparatus. To increase the ability of the assembled apparatus to retain objects deposited therein, the upper portion of the connection flap means preferably extends approximately one-quarter to one-third the width of the end wall means. Similarly, towards increasing the ability of the apparatus to retain objects deposited therein, the end panel means are of a height approximately twice the height of the end wall means thus effectively creating walls which, prior to facilitated closure and sealing, are substantially greater than the depth of the apparatus after closure and sealing.

In one embodiment of the invention, the lower portion of the connection flap is a width substantially equal to the full width of the upper portion of the connection flap means to which it is attached. In an alternative embodiment of the invention, the lower portion of the connection flap means is of a width substantially one-third the overall width of the upper portion of the connection flap means to which it is attached, for reducing the potential folding resistance occurring upon articulation of the connection flap means during closing and sealing of the apparatus.

In the preferred embodiment of the invention, the side wall fold edges, top panel fold edges, end wall fold edges, and end panel fold edges include a plurality of perforations formed therewithin.

In the preferred embodiment of the invention also, the end panel means are juxtaposed and affixed to the connection flap means by adhesive attachment means.

Further, the bottom panel means, the two side wall panel means, the two top panel means, the two end wall means, the two end panel means and the connection flap means are all formed from a single substantially continuous sheet of apparatus material and the side wall fold edges, top panel fold edges, end wall fold edges, end panel fold edges and connection flap fold edges each comprise scored fold lines having perforations formed therewithin. Moreover, in the preferred embodiment, the articulated tray apparatus is preferably formed from a single substantially continuous sheet of corrugated cardboard material.

BRIEF DESCRIPTION OF THE DRAWINGS

FIG. 8 of the drawings is an outer perspective view of the container construction utilized in the prior art, specifically illustrating the prior art's corner attachment construction;

FIG. 9 of the drawings is an inner perspective view of the prior art container construction of FIG. 8 specifically illustrating its corner tab member construction; and FIG. 10 of the drawings is a partial outer side perspective view of the prior art container construction of FIG. 8 specifically illustrating its two-piece corner tab-flap construction.

DETAILED DESCRIPTION OF THE DRAWINGS

Figure 1:
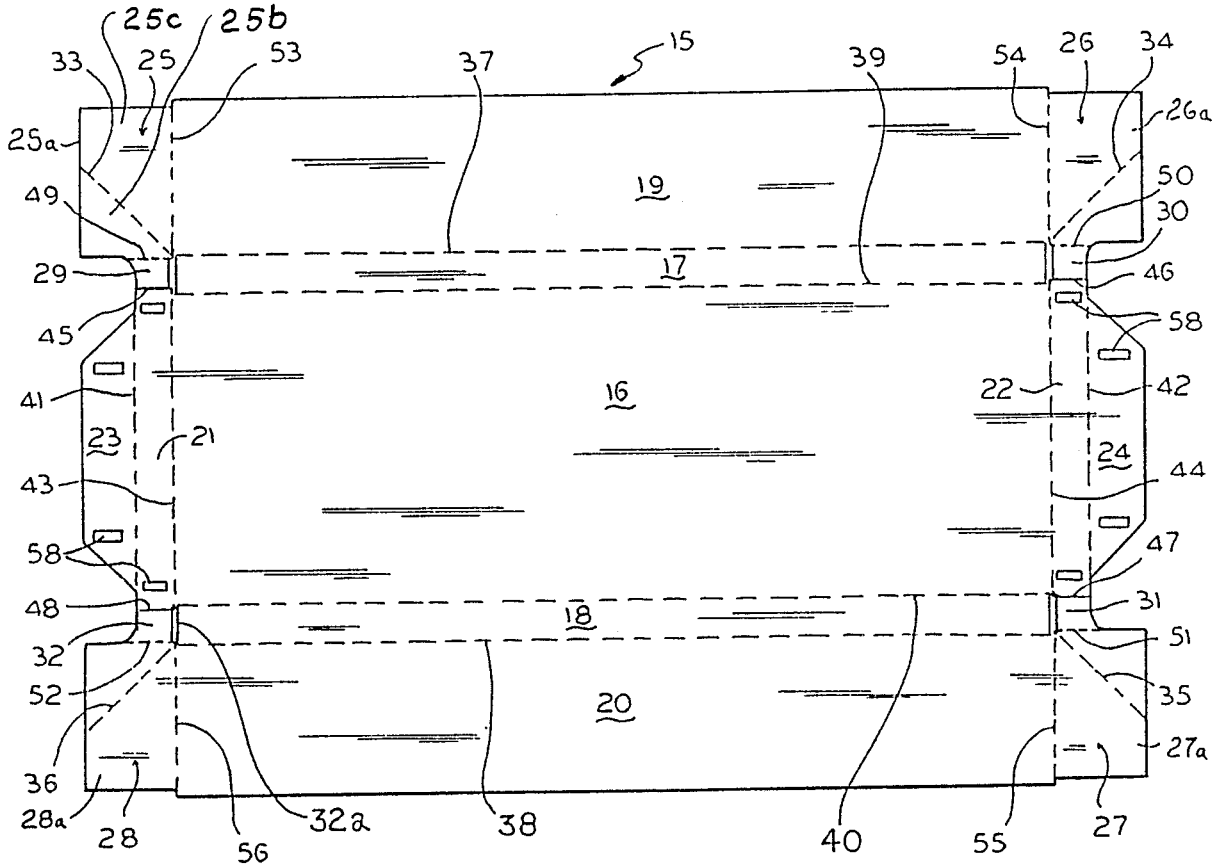
FIG. 1 of the drawings is a top plan view of the unarticulated container blank for the present tray apparatus in which the bottom panel, side walls, top panels, end walls, end panels and connection flaps are shown, together with respective fold edges therebetween.

While this invention is susceptible of embodiment in many different forms, there is shown in the drawings and will herein be described in detail several specific embodiments, with the understanding that the present invention disclosure is to be considered an exemplification of the principles of the invention and is not intended to limit the invention to the embodiments illustrated.

Container blank 15 for the tray apparatus is shown in FIG. 1 as being formed from a substantially continuous sheet of material, which, upon articulation, forms a closed wall periphery, shallow depth container for piece-part containment.

Bottom panel 16 forms the bottom of the container cavity. Side walls 17 and 18 are shown attached to bottom panel 16 along substantially continuous respective side wall fold edges designated by perforated lines 39 and 40. Top panels 19 and 20, which form the tops of the container, upon articulation of the apparatus, are shown attached to side walls 17 and 18 respectively, along respective top panel fold edges, 37 and 38.

End walls 21 and 22 are shown attached to bottom panel 16 along end wall fold edges 43 and 44, respectively. Attached to end walls 21 and 22, are end panels 23 and 24, attached along end panel fold edges 41 and 42, respectively. When articulated, side walls 17 and 18, end walls 21 and 22 together with bottom panel 16 define a closed peripheral wall cavity for containing objects to be deposited therewithin. Accordingly, and as further illustrated in additional FIGURES, the height of side walls 17 and 18 and end walls 21 and 22 determine the depth of the container upon articulation of the container blank into an erect tray apparatus.

Attached at each end of top panel 19 and preferably, side wall 17 also, are respective connection flaps 25 and 26. Similarly, attached to top panel 20 and, preferably side wall 18 also, are respective connection flaps 27 and 28.

Connection flaps 25, 26, 27, and 28 are each shown comprising an upper portion designated **25*a*, 26*a*, 27*a*, and 28*a*; and a lower portion designated 29, 30, 31, and 32, respectively. As illustrated, the upper portions of each respective connection flap 25, 26, 27, and 28 are attached to their respective lower portions 29, 30, 31, and 32 by respective connection fold lines designated 49, 50, 51, and 52. In this preferred embodiment, lower flap portions 29, 30, 31 and 32 are further attached to respective ones of side walls 17 and 18 by a non-scored crease, such as crease 32*a* between lower portion 32 and side wall 18**.

As further shown, the other various fold lines and articulation lines utilized within the apparatus, such as fold lines 37 and 39, include perforations and/or similar scoring formed into the container blank 15 during fabrication thereof. In the preferred embodiment, lower portions 29, 30, 31, and 32 of respective connection flaps 25, 26, 27 and 28 are separated from connection with respective end walls 21 and 22, through respective slits 45 through 48 therebetween.

Connection flaps 25, 26, 27, and 28 are each shown connected to adjacent respective top panels 19 and 20 by way of fold lines 53, 54, and 55 and 56 respectively. Connection flaps 25 through 28 are further shown as including respective articular fold lines 33 through 36 which, upon closure of the apparatus as further illustrated in FIGS. 5 and 6, fold to re-orient flap portions such as upper flap portion **25*c* in overlying fashion relative to upper flap portion 25*b***.

Figure 2:
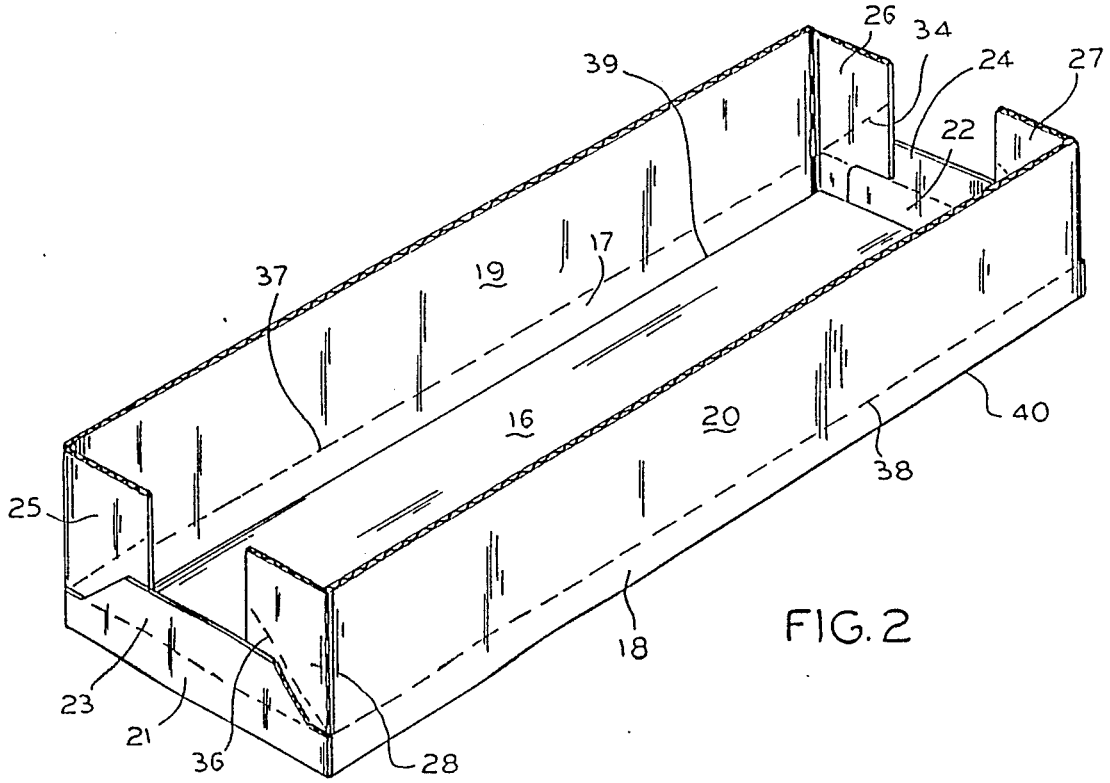
FIG. 2 of the drawings is a front perspective view of the container blank upon initial articulation, prior to filling, illustrating the formation of a continuous uninterrupted periphery of side walls and end panels for containing objects positioned therewithin.
Figure 3:
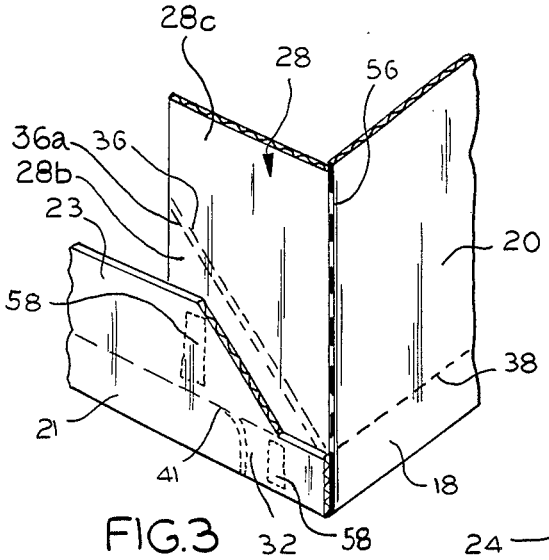
FIG. 3 of the drawings is an outer perspective view of a corner of the container blank upon articulation into the open tray apparatus, illustrating the attachment of the end wall and end panel to the connection flap, towards juxtaposing the end wall to the side wall and towards connecting the end panel, through the connection flap, to the top panel, respectively.

Additionally shown in FIG. 1 are adhesive application areas 58 designating the area of application of adhesive upon end walls 21 and 22 and end panels 23 and 24 prior to articulation and erection of the apparatus blank 15, as further illustrated in FIG. 3. In practice, the adhesive is applied by automated tray former equipment which, in turn, articulates the container blank 15 into a formed open tray apparatus illustrated in FIG. 2.

FIG. 2 of the drawings further illustrates the container blank assembled into tray apparatus 15, as having a relatively shallow depth defined by the height of the end walls 21, 22 and side walls 17 and 18. FIG. 2 illustrates how, upon articulation, side walls 17 and 18 and respective top panels 19 and 20 joined thereto at fold lines 37 and 38, form the respective overall sides and tops for apparatus 15. Likewise, end walls 21 and 22, end flaps 23 and 24, and connection flaps 25, 26, 27 and 28, upon articulation, together form the remaining walls of the container, with an enclosed wall periphery such that materials deposited therein will be effectively retained within the apparatus as the tray apparatus moves down a container packaging line. In the embodiment illustrated, the dimensions of the respective top panels, end panels and connection flaps serve to create a wall construction of significantly greater height then would otherwise be obtained by merely relying upon side walls 17 and 18 and end walls 21 and 22, to better retain objects deposited within apparatus 15 as it moves along a piece-part packing conveyor. Moreover, FIG. 2 of the drawings illustrates the positions of attachment of the respective connection flaps 25, 26, 27, and 28 relative to the adjacent end walls 21 and 22, and end panels 23 and 24, respectively.

FIG. 3 of the drawings is a detailed perspective view of the outer corner construction of apparatus 15, upon assembly of the container blank therefore. Side wall 18 and end wall 21 are shown juxtaposed to one another upon affixation of end wall 21 and end panel 23 to connection flap 28. Accordingly, end wall 21 and side wall 18 determine the depth of the particular tray apparatus. End panel 23 is shown juxtaposed and affixed to one side 28*b* of connection flap upper portion 28*b–c*, by adhesive 58 applied therebetween. End wall 21 is similarly juxtaposed and attached to the lower portion 32 of connection flap 28, by adhesive 58. deposited therebetween. In this embodiment, the articulation flap fold line comprises double fold lines 36 and 36*a* operably positioned between flap side 28*c* and flap side 28*b* to further facilitate folding therebetween.

In the embodiment illustrated, a right angle corner is formed at the intersection of end wall 21 and side wall 18 upon the articulation and affixation of connection flap 28, emanating from top flap panel 20, to end wall 21 and end panel 23. In this preferred embodiment, side wall 18 and top panel 20 are collectively attached to connection flap 28 along substantially continuous fold line 56, which in the embodiment illustrated, includes scored or perforated fold line portions outside the vicinity of lower flap connection portion 32 attached by crease 32*a* to side wall 18, as shown in FIG. 1. As further shown in this FIGURE, connection flap 28 extends approximately the entire height of the combined height of side wall 18 and top panel 20, stopping just short of the upper-most edge of top panel 20, in order to minimize interference of the respective panels upon articulation of the container, when closing of the apparatus tops is performed.

Figure 4:
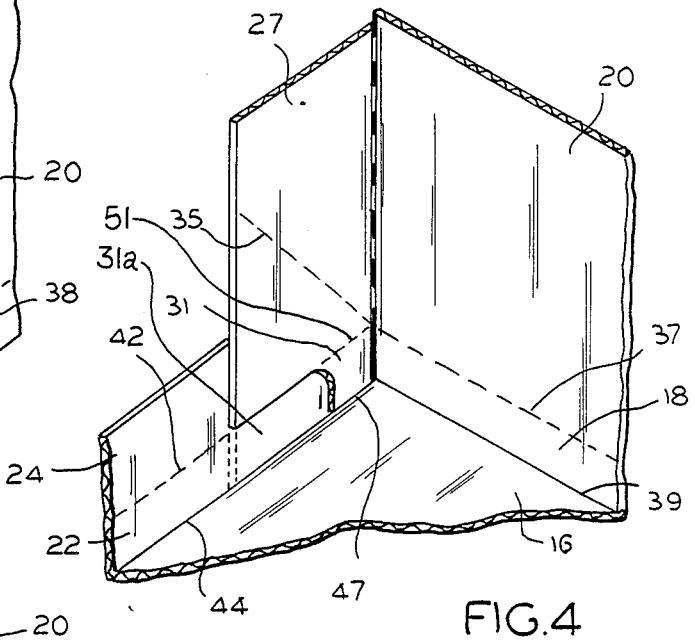
FIG. 4 of the drawings is an inner perspective view of a corner of the apparatus, upon articulation into an open tray, showing the juxtaposition and attachment of the end panel and end wall to the upper and lower portions respectively of the connection flap.

FIG. 4 of the drawings further illustrates the erection of tray apparatus 15 and formation of an interior right angle corner upon articulation of connection flap 27 relative to top panel 20. In the preferred embodiment, as illustrated herein, the upper portion of connection flap 27 extends approximately the entire height of top panel 20, and the lower portion 31 of connection flap 27 is approximately equal in height to the height of end wall 22. However, in this embodiment, the lower portion 31 of connection flap 27 is of a width only approximately one-third of the width of overall connection flap 27, as opposed to an alternative embodiment in which lower portion 31*a* (shown in phantom) is of the same width as the upper portion of connection flap 27. With the narrower lower portion 31, less precision is required in the erection of the apparatus blank and in affixation of the end wall and end panels to the connection flap. Moreover, less resistance also is encountered upon folding, in situations where fold line 51 might not precisely align with end panel fold line 42.

Figure 5:
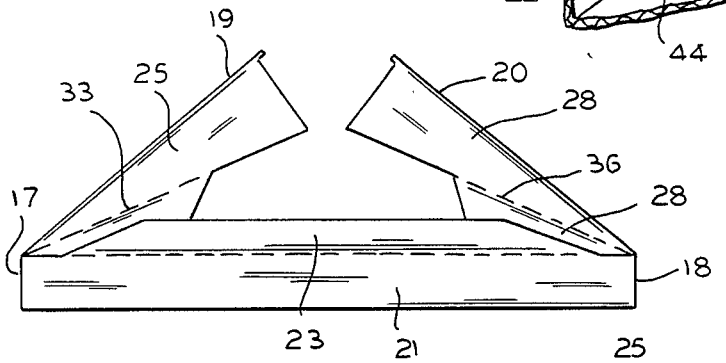
FIG. 5 of the drawings is a side elevational view of the tray apparatus illustrating the articulation of the respective articulation flap fold lines of the connection flap and the end panel fold line, upon initiating closure of the apparatus.

FIG. 5 of the drawings illustrates the articulation of the container upon initiation of closing of the apparatus. Top panels 19 and 20 are each shown in the process of being closed, wherein connection flaps 25 and 28 are caused to articulate about articulation flap fold lines 33 and 36, respectively, toward reorienting, for example, connection flap element 25*c* over connection flap element 25*b* as shown in FIG. 1. Moreover, end panel 23 is shown articulating about end panel fold line 41, relative to end wall 21 as the container is closed. In view of the connection between end panel 23 and connection flaps 25 and 28, the closure of top panels 19 and 20 causes articulation of connection flaps 25 and 28, and in turn, inward rotation of end panel 23 towards overall closure and sealing of the apparatus.

Figure 6:
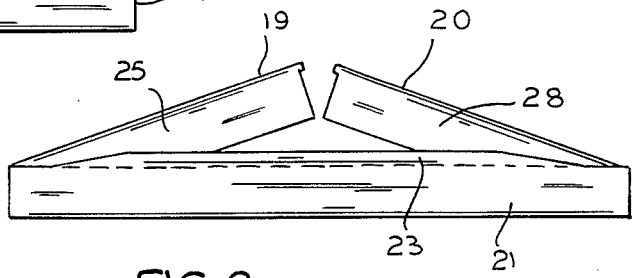
FIG. 6 of the drawings is a side elevational view of the present articulated tray apparatus in a further stage of closure.

FIG. 6 of the drawings illustrates apparatus 15 in a further stage of being closed towards sealing, wherein connection flaps 25 and 28 are in a further stage of articulation, as is end panel 23. As can be seen in FIGS. 5 and 6, the closure of the container folds connection flaps 25 and 28 downwardly and inwardly to ultimately juxtapose the two portions of each connection flap, such as flap portion 28*c* over flap portion 28*b* and flap portion 25*c* over flap portion 25*b*, along respective articulation fold lines 36 and 33.

Figure 7:
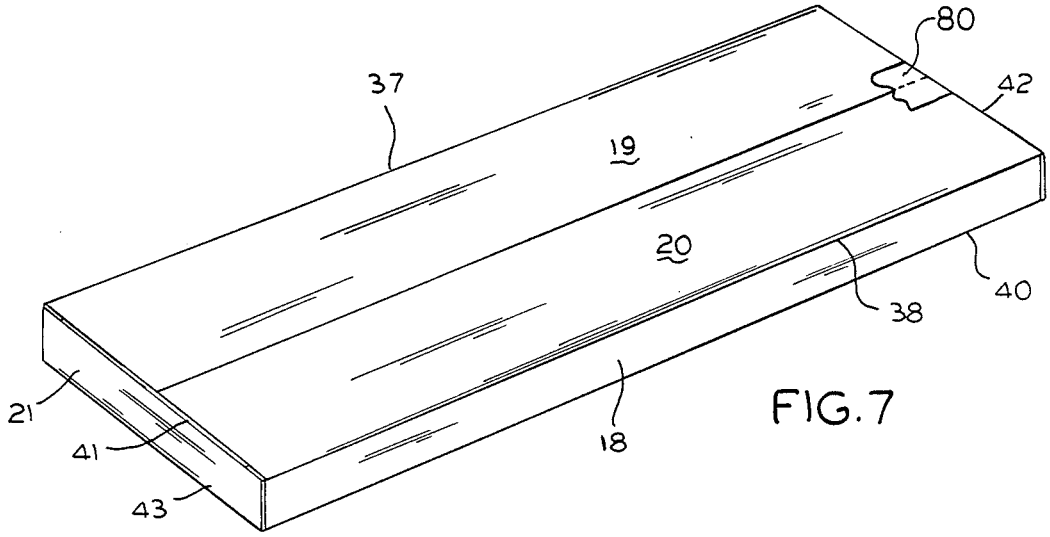
FIG. 7 of the drawings is a front perspective view of the present tray apparatus upon articulation, illustrating the configuration of the container when fully closed.

FIG. 7 of the drawings illustrates tray apparatus 15 in its closed orientation ready to accept sealing tape 80 or the like. As can be seen, a relatively shallow depth closed container results from articulation of the container blank 15 disclosed herein, the shallow depth being defined by end wall 21 and side wall 18. Complete closure of the apparatus is achieved through the transverse articulation of top panels 19 and 20 about the respective top panel fold lines 37 and 38. Respective ends and sides of the container have similarly been formed by articulation of end panel 21 and side wall 18 about end wall fold line 43 and side wall fold line 40, respectively, together with the articulated closure of end panels 23 and 24 (not shown) about respective end panel fold lines 41 and 42. As can be seen, assembly, erection and closure of the tray apparatus may be accomplished without the need to manipulate, align, or adhere relatively small corner tabs, and without separate articulation of independent closure flaps or walls.

FIGS. 8 and 9 of the drawings illustrate a typical prior art tray carton wherein the depth of the carton is defined by the height of side wall and end wall 62 and 63. A portion of the lid of the carton is defined by top 61. In this construction the corner of the carton is formed by the juxtaposition of side wall 62 and end wall 63 wherein a connection assembly 64, 65, 67 and 68 effects the joining of the side wall and end wall. Main connection member 65 is shown attached to an end panel 64 about fold line 66. Attached to the opposite side of main connection member 65 is an upper attachment member 67 which is affixed to top 61. The interior view illustrated in FIG. 9 shows corner tab 68, a small flap element, aligned with side wall 62. Corner tab 68 emanates directly and solely from end wall 63 with no attachment to any of connection members 65 or 67.

In this prior art carton construction, attachment member 67 is shown adhered to the exterior surface of top 61 while corner tab 68 is shown adhered to the interior surface of side wall 62. In order to assemble this prior art container one must manipulate and precisely align corner tab 68 with the interior surface of side wall 62. Corner tab 68 must thereafter be adhered to side wall 62. In a shallow depth container as illustrated herein, side walls and end walls have a relatively narrow width and accordingly, corner tab 68 must be no larger in at least any one dimension. Moreover, if corner tab 68 is improperly aligned and/or adhered to side wall 62, the corner tab may interfere with the closure of the carton should it project above the topmost edge of side wall 62. The narrower the carton, the smaller corner tab 68 must be tailored, thus making it increasingly difficult to assemble the carton from a pre-cut carton blank by use of automated equipment.

FIG. 10 of the drawings is an illustration of the same prior art container of FIGS. 8 and 9 being closed, wherein it can be seen, upon folding of top panels 61 and 71, that connection members 65 and 73 fold into the interior of the container without the aid of articulation fold lines extending therethrough. Moreover, and more significantly, attachment members 67 and 72 are not connected to corner tabs 68 and 74 as evidenced by gap 75. This prior art construction may therefore require independent handling, alignment and affixation during the assembly of the carton, efforts which again frustrate the use of automatic carton formation equipment.

The foregoing description and drawings merely explain and illustrate the invention and the invention is not limited thereto, except insofar as the amended claims are so limited as to those skilled in the art who have the disclosure before them will be able to make modifications and variations therein without departing from the scope of the invention.

What is claimed is:

1. An articulated tray apparatus for formation into a shallow depth container for use in effectively retaining and containing piece-part objects, without substantially narrow corner tab members, to thereby enable formation of said apparatus by automated mechanical tray forming erection equipment, and for further permitting the automated closure and sealing of said apparatus, said apparatus comprising:

bottom panel means forming the bottom of said articulated tray apparatus;

at least two upstanding opposite side walls means operably attached for articulation to said bottom panel means along substantially continuous respective side wall fold edges therebetween;

at least two opposite top panel means operably attached for articulation to said respective upstanding opposite side wall means along substantially continuous respective top panel fold edges therebetween;

at least two upstanding opposite end wall means operably attached for articulation to said bottom panel means along substantially continuous respective end wall fold edges therebetween;

at least two opposite end panel means operably attached for articulation to said respective upstanding opposite end wall means, along substantially continuous respective end panel fold edges therebetween;

one or more connection flap means operably attached at opposite ends of each of said top panel means for juxtaposing upon articulation of said apparatus, said side wall means to said adjacent end wall means, and said top panel means to said adjacent end panel means, each of said connection flap means having an upper portion and a lower portion, said upper portion being connected to said lower portion at a connection flap fold line which is articulatable upon closure of said container, said upper portions of each of said connection flap means further including an articulation fold line extending from each of said top panel fold lines diagonally across said upper portions of each of said connection flap means to further facilitate the articulation of said connection flap means toward the automated closure and sealing of said apparatus;

said end panel means being juxtaposed and affixed to said connection flap means thereby providing an open sealable container capable of receiving and retaining objects within a substantially continuous closed wall periphery while enabling automated erection, and facilitated closure and sealing of said articulated tray apparatus.

2. The invention according to claim 1 in which each of said end wall means are further juxtaposed and affixed to said adjacent connection flap means upon articulation of said tray apparatus to reinforce the juxtaposition of said end wall means and said side wall means.

3. The invention according to claim 2 in which said end panel means are juxtaposed and affixed to said upper portions of said adjacent connection flap means;

said end wall means being juxtaposed and affixed to said lower portions of said adjacent connection flap means.

4. The invention according to claim 1 wherein said upper portions of each of said connection flap means further include a second articulation fold line extending substantially parallel to said first articulation fold line to further facilitate the articulation of said connection flap means toward the automated closure and sealing of said apparatus.

5. The invention according to claim 4 wherein said first and second articulation fold lines include a plurality of perforations formed therewithin.

6. The invention according to claim 1 wherein said upper portions of each of said connection flap means are attached to and extend substantially the entire height of said top panel means to further assist in retaining objects deposited within said apparatus, prior to the facilitated closing and sealing of said apparatus.

7. The invention according to claim 1 wherein the width of said upper portions of each of said connection flap means extend approximately one-quarter to one-third the width of said end wall means.

8. The invention according to claim 1 wherein said end panel means are each of a height substantially twice the height of said end wall means to further assist in retaining objects deposited within said apparatus prior to the facilitated closing and sealing of said apparatus.

9. The invention according to claim 1 wherein said lower portions of each of said connection flap means are each of a width substantially one-third the overall width of said upper portions of each of said connection flap means for reducing the potential resistance occurring upon articulation of said connection flap means, during the facilitated closing and sealing of said apparatus.

10. The invention according to claim 1 wherein said side wall fold edges, top panel fold edges, end wall fold edges, and end panel fold edges include a plurality of perforations formed and scored therewithin.

11. The invention according to claim 1 wherein said end panel means are juxtaposed and affixed to said connection flap means by adhesive attachment means.

12. The invention according to claim 1 in which said bottom panel means, said at least two side wall means, said at least two top panel means, said at least two end wall means, said at least two end panel means and said one or more connection flap means are formed from a single substantially continuous sheet of apparatus material, said side wall fold edges, said top panel fold edges, said end panel fold edges and said connection flap fold lines each comprising scored fold lines having perforations formed therewithin.

13. The invention according to claim 12 wherein said articulated tray apparatus is formed from a single substantially continuous sheet of corrugated cardboard material.

14. An articulated tray apparatus for formation into a shallow depth container for use in effectively retaining and containing piece-part objects, without substantially narrow corner tab members, to thereby enable formation of said apparatus by automated mechanical tray forming erection equipment, and for further permitting the automated closure and sealing of said apparatus, said apparatus comprising:

bottom panel means forming the bottom of said articulated tray apparatus;

at least two upstanding opposite side wall means operably attached for articulation to said bottom panel means along substantially continuous respective side wall fold edges therebetween;

at least two opposite top panel means operably attached for articulation to said respective upstanding opposite side wall means along substantially continuous respective top panel fold edges therebetween;

at least two upstanding opposite end wall means operably attached for articulation to said bottom panel means along substantially continuous respective end wall fold edges therebetween;

at least two opposite end panel means operably attached for articulation to said respective upstanding opposite end wall means, along substantially continuous respective end panel fold edges therebetween;

one or more connection flap means operably attached at opposite ends of each of said top panel means for juxtaposing upon articulation of said apparatus, said side wall means to said adjacent end wall means, and said top panel means to said adjacent end panel means, each said one or more connection flap means being substantially wider in configuration relative to the height of said adjacent end wall means so as to position the top of said connection flap means substantially higher than the top of said adjacent end wall means upon articulation, to thereby form a substantial enclosure corner about a substantially shallow tray member;

each of said connection flap means having an upper portion and a lower portion, said upper portion being connected to said lower portion at a connection flap fold line which is articulatable upon closure of said container.

said end panel means being juxtaposed and affixed to said connection flap means thereby providing an open sealable container capable of receiving and retaining objects within a substantially continuous closed wall periphery while enabling automated erection, and facilitated closure and sealing of said articulated tray apparatus.

* * * * *